US008850820B2

(12) United States Patent
Milosavljevic et al.

(10) Patent No.: US 8,850,820 B2
(45) **Date of Patent: *Oct. 7, 2014**

(54) BURNER

(75) Inventors: Vladimir Milosavljevic, Norrköping (SE); Allan Persson, Norrköping (SE); Magnus Persson, Norrköping (SE)

(73) Assignee: Siemens Aktiengesellschaft, Munich (DE)

( * ) Notice: Subject to any disclaimer, the term of this patent is extended or adjusted under 35 U.S.C. 154(b) by 985 days.

This patent is subject to a terminal disclaimer.

(21) Appl. No.: 12/935,940

(22) PCT Filed: Mar. 26, 2009

(86) PCT No.: PCT/EP2009/053585

§ 371 (c)(1),
(2), (4) Date: Oct. 1, 2010

(87) PCT Pub. No.: WO2009/121790

PCT Pub. Date: Oct. 8, 2009

(65) Prior Publication Data

US 2011/0030376 A1 Feb. 10, 2011

(30) Foreign Application Priority Data

Apr. 1, 2008 (EP) ..... 08006659

(51) Int. Cl.
*F02C 7/22* (2006.01)

(52) U.S. Cl.
USPC ..... 60/737; 60/748

(58) Field of Classification Search
USPC ..... 60/737, 748, 749
See application file for complete search history.

(56) References Cited

U.S. PATENT DOCUMENTS

| | | | | |
|---|---|---|---|---|
| 3,455,108 | A | 7/1969 | Clare | |
| 4,508,502 | A * | 4/1985 | Itoh | 431/328 |
| 5,394,688 | A * | 3/1995 | Amos | 60/748 |
| 5,409,375 | A * | 4/1995 | Butcher | 431/328 |

(Continued)

FOREIGN PATENT DOCUMENTS

| | | |
|---|---|---|
| EP | 0691511 A1 | 1/1996 |
| EP | 1319895 A2 | 6/2003 |

(Continued)

OTHER PUBLICATIONS

Leung, Y. C. and Ko, N. W. M. "Near-wall characteristics of flow over grooved circular cylinder" 1991, Experiments in Fluids 10, pp. 322-332.*

(Continued)

*Primary Examiner* — Ted Kim

(57) ABSTRACT

A burner including a gas injector for injecting fuel into the burner for a gas turbine engine is provided. The burner is provided with a quarl, which surrounds a combustion room, at least a first channel emerging into the combustion room for providing the combustion room with air mixed with fuel, a swirler for mixing the air and the fuel located at the inlet of the channel, at least one tube for the provision of fuel at an inlet of at least one channel, wherein the tube is provided with a plurality of diffuser holes distributed along the tube acting as gas injectors for effectively distributing fuel in a flow of air passing through the channel.

6 Claims, 6 Drawing Sheets

(56) References Cited

U.S. PATENT DOCUMENTS

| | | | | |
|---|---|---|---|---|
| 5,647,215 | A | 7/1997 | Foss | |
| 5,660,039 | A | 8/1997 | Sion et al. | |
| 5,983,642 | A | 11/1999 | Parker et al. | |
| 6,253,555 | B1 | 7/2001 | Willis | |
| 8,033,112 | B2 * | 10/2011 | Milosavljevic et al. | 60/737 |
| 8,220,271 | B2 * | 7/2012 | Poyyapakkam et al. | 60/737 |
| 2006/0059915 | A1 * | 3/2006 | Furletov et al. | 60/748 |
| 2007/0113555 | A1 | 5/2007 | Carroni | |

FOREIGN PATENT DOCUMENTS

| | | | |
|---|---|---|---|
| EP | 1482244 | A1 | 12/2004 |
| GB | 1555058 | A | 11/1979 |
| RU | 2129219 | C1 | 4/1999 |

OTHER PUBLICATIONS

Huang (2010). "Cylinder drag reduction by the use of helical grooves." Proceedings of the Hydralab III Joint Transnational Access User Meeting, Hannover, Germany.*

Huang, "Preliminary Tank Testing of VIV Suppression of Helical Grooves," 2006, Author Affiliations Paper No. OMAE2006-92002; 25th International Conference on Offshore Mechanics and Arctic Engineering vol. 4: Terry Jones Pipeline Technology; Ocean Space Utilization; CFD and VIV Symposium Hamburg, Germany, Jun. 4-9, 2006, pp. 469-473.*

* cited by examiner

BURNER

CROSS REFERENCE TO RELATED APPLICATIONS

This application is the US National Stage of International Application No. PCT/EP2009/053585, filed Mar. 26, 2009 and claims the benefit thereof. The International Application claims the benefits of European Patent Office application No. 08006659.0 EP filed Apr. 1, 2008. All of the applications are incorporated by reference herein in their entirety.

TECHNICAL FIELD

The present invention refers to a gas injector for injecting fuel into a flow of air in a swirler of a burner for a gas turbine engine, at least one said gas injector arranged to be located at an inlet of a channel of said swirler.

TECHNICAL BACKGROUND

Gas turbine engines are employed in a variety of applications including electric power generation, military and commercial aviation, pipeline transmission and marine transportation. In a gas turbine engine which operates in LPP mode, fuel and air are provided to a burner chamber where they are mixed and ignited by a flame, thereby initiating combustion. The major problems associated with the combustion process in gas turbine engines, in addition to thermal efficiency and proper mixing of the fuel and the air, are associated to flame stabilization, the elimination of pulsations and noise, and the control of polluting emissions, especially nitrogen oxides (NOx), CO, UHC, smoke and particulated emission.

U.S. Pat. No. 5,983,642 A1 shows a combustor for a gas turbine with a centrally located fuel nozzle, which is meant to distribute fuel in an air flow. The patent application EP 1 482,244 A1 discloses a burner system, wherein for the purpose to distribute fuel in a gas flow a nozzle injects this fuel at a counterflow angle to improve the mixing. Patent specification GB 1 555 058 discloses a gas burner for gas heating, wherein nozzles are used to distribute a fuel to be burned in a gas flow.

In industrial gas turbine engines, which operate in LPP mode, flame temperature is reduced by an addition of more air than required for the combustion process itself. The excess air that is not reacted must be heated during combustion, and as a result flame temperature of the combustion process is reduced (below stoichiometric point) from approximately 2300K to 1800 K and below. This reduction in flame temperature is required in order to significantly reduce NOx emissions. A method shown to be most successful in reducing NOx emissions is to make combustion process so lean that the temperature of the flame is reduced below the temperature at which diatomic Nitrogen and Oxygen (N2 and O2) dissociate and recombine into NO and NO2. Swirl stabilized combustion flows are commonly used in industrial gas turbine engines to stabilize combustion by, as indicated above, developing reverse flow (Swirl Induced Recirculation Zone) about the centreline, whereby the reverse flow returns heat and free radicals back to the incoming un-burnt fuel and air mixture. The heat and free radicals from the previously reacted fuel and air are required to initiate (pyrolyze fuel and initiate chain branching process) and sustain stable combustion of the fresh un-reacted fuel and air mixture. Stable combustion in gas turbine engines requires a cyclic process of combustion producing combustion products that are transported back upstream to initiate the combustion process. A flame front is stabilised in a Shear-Layer of the Swirl Induced Recirculation Zone. Within the Shear-Layer "Local Turbulent Flame Speed of the Air/Fuel Mixture" has to be higher then "Local Air/Fuel Mixture Velocity" and as a result the Flame Front/combustion process can be stabilised.

Lean premixed combustion is inherently less stable than diffusion flame combustion for the following reasons:

The amount of air required to reduce the flame temperature from 2300K to 1700-1800 K is approximately twice the amount of air required for stoichiometric combustion. This makes the overall fuel/air ratio ($\Phi$) very close (around or below 0.5; $\Phi \geq 0.5$) or similar to a fuel/air ratio at which lean extinction of the premixed flame occurs. Under these conditions the flame can locally extinguish and re-light in a periodic manner.

Near the lean extinction limit the flame speed of the lean partially premixed flames is very sensitive to the equivalence ratio fluctuations. Fluctuations in flame speed can result in spatial fluctuations/movements of the flame front (Swirl Induced Recirculation Zone). A less stable, easy to move flame front of a pre-mixed flame results in a periodic heat release rate, that, in turn, results in movement of the flame, unsteady fluid dynamic processes, and thermo-acoustic instabilities develop.

Equivalence ratio fluctuations are probably the most common coupling mechanism to link unsteady heat release to unsteady pressure oscillations.

In order to make the combustion sufficiently lean, in order to be able to significantly reduce NOx emissions, nearly all of the air used in the engine must go through the injector and has to be premixed with fuel. Therefore, all the flow in the burners has the potential to be reactive and requires that the point where combustion is initiated is fixed.

When the heat required for reactions to occur is the stability-limiting factor, very small temporal fluctuations in fuel/air equivalence ratios (which could either result either from fluctuation of fuel or air flow through the Burner/Injector) can cause flame to partially extinguish and re-light.

An additional and very important reason for the decrease in stability in the pre-mixed flame is that the steep gradient of fuel and air mixing is eliminated from the combustion process. This makes the premixed flow combustible anywhere where there is a sufficient temperature for reaction to occur. When the flame can, more easily, occur in multiple positions, it becomes more unstable. The only means for stabilizing a premixed flame to a fixed position are based on the temperature gradient produced where the unburnt premixed fuel and air mix with the hot products of combustion (flame cannot occur where the temperature is too low). This leaves the thermal gradient produced by the generation, radiation, diffusion and convection of heat as a method to stabilize the premixed flame. Radiation heating of the fluid does not produce a sharp gradient; therefore, stability must come from the generation, diffusion and convection of heat into the pre-reacted zone. Diffusion only produces a sharp gradient in laminar flow and not turbulent flows, leaving only convection and energy generation to produce the sharp gradients desired for flame stabilization which is actually heat and free radial gradients. Both, heat and free radial gradients, are generated, diffused and convected by the same mechanisms through recirculating products of combustion within the Swirl Induced Recirculation Zone.

In pre-mixed flows, as well as diffusion flows, rapid expansion causing separations and swirling recirculating flows, are both commonly used to produce gradients of heat and free radicals into the pre-reacted fuel and air.

An object of the present invention is to improve the mixing efficiency of air and fuel to further enhance the efficiency of the burner.

SUMMARY OF THE INVENTION

The aspects related to the gas injectors according to the present invention is described herein, as an example, in connection with a lean-rich partially premixed low emissions burner for a gas turbine combustor that provides stable ignition and combustion process at all engine load conditions. This burner operates according to the principle of "supplying" heat and high concentration of free radicals from a pilot combustor exhaust to a main flame burning in a lean premixed air/fuel swirl, whereby a rapid and stable combustion of the main lean premixed flame is supported. The pilot combustor supplies heat and supplements a high concentration of free radicals directly to a forward stagnation point and a shear layer of the main swirl induced recirculation zone, where the main lean premixed flow is mixed with hot gases products of combustion provided by the pilot combustor. This allows a leaner mix and lower temperatures of the main premixed air/fuel swirl combustion that otherwise would not be self-sustaining in swirl stabilized recirculating flows during the operating conditions of the burner.

According to a first aspect of the invention there is herein presented gas injectors characterized by the features of the claims.

According to a second aspect of the invention there is presented a method for burning a fuel as characterized by the steps of the independent method claim.

Further aspects of the invention are presented in the dependent claims.

U.S. Pat. No. 5,983,642 discloses a fuel tube for distributing fuel to an air flow from at least one row of diffuser holes but does not show circular or helical V-formed grooves along the gas injector tube's outer surface and an arrangement of the diffuser holes at the bottom of the grooves. These features are essential to obtain the advantages made available by the invention.

EP-A-1 482 244 proposes to use V-formed grooves to improve the air-fuel mixing process, but the disclosed V-formed groove (only one) is arranged on a nozzle being attached to the fuel tube and the fuel is diffused from the diffuser hole to an air flow in parallel to the fuel tube. In contrast to this the air flow of the present invention is perpendicular to the fuel tube and the diffusor holes are arranged at the bottom of the V-formed grooves. This location is important as the fuel will diffuse to a vortex of air generated between the V-formed walls of the grooves, whereby the fuel will be introduced at the initial points of said vortices and generate a row of said vortices along the fuel tube as the diffusor holes are arranged in a row.

The burner utilizes:

A swirl of air/fuel above swirl number (Sn) 0.7 (that is above critical Sn=0.6), generated-imparted into the flow, by a radial swirler;

active species—non-equilibrium free radicals being released close to the forward stagnation point, particular type of the burner geometry with a multi quarl device, and internal staging of fuel and air within the burner to stabilize combustion process at all gas turbine operating conditions.

In short, the disclosed burner provides stable ignition and combustion process at all engine load conditions. Some important features related to the inventive burner are:

the geometric location of the burner elements;

the amount of fuel and air staged within the burner;

the minimum amount of active species—radicals generated and required at different engine/burner operating conditions;

fuel profile;

mixing of fuel and air at different engine operating conditions;

imparted level of swirl;

multi (minimum double quarl) quarl arrangement.

To achieve as low as possible emission levels, a target in this design/invention is to have uniform mixing profiles at the exit of lean premixing channels. Two distinct combustion zones exist within the burner covered by this disclosure, where fuel is burnt simultaneously at all times. Both combustion zones are swirl stabilized and fuel and air are premixed prior to the combustion process. A main combustion process, during which more than 90% of fuel is burned, is lean. A supporting combustion process, which occurs within the small pilot combustor, wherein up to 1% of the total fuel flow is consumed, could be lean, stoichiometric and rich (equivalence ratio, $\Phi$=1.4 and higher).

The main reason why the supporting combustion process in the small pilot combustor could be lean, stoichiometric or rich and still provide stable ignition and combustion process at all engine load conditions is related to combustion efficiency. The combustion process, which occurs within the small combustor-pilot, has low efficiency due to the high surface area which results in flame quenching on the walls of the pilot combustor. Inefficient combustion process, either being lean, stoichiometric or rich, could generate a large pool of active species—radicals which is necessary to enhance stability of the main lean flame and is beneficial for a successful operation of the present burner design/invention (Note: the flame occurring in the premixed lean air/fuel mixture is herein called the lean flame).

It would be very difficult to sustain (but not to ignite, because the small pilot combustor can act as a torch igniter) combustion in the shear layer of the main recirculation zone below LBO (Lean Blow Off) limits of the main lean flame (approx. T>1350 K and $\Phi \geq 0.25$). For engine operation below LBO limits of the main lean flame, in this burner design, additional "staging" of the small combustor-pilot is used/provided. The air which is used to cool the small pilot combustor internal walls (performed by a combination of impingement and convecting cooling) and which represents approximately 5-8% of the total air flow through the burner, is premixed with fuel prior the swirler. Relatively large amount of fuel can be added to the small pilot combustor cooling air which corresponds to very rich equivalence ratios ($\Phi$>3). Swirled cooling air and fuel and hot products of combustion from the small pilot combustor, can very effectively sustain combustion of the main lean flame below, at and above LBO limits. The combustion process is very stable and efficient because hot combustion products and very hot cooling air (above 750° C.), premixed with fuel, provide heat and active species (radicals) to the forward stagnation point of the main flame recirculation zone. During this combustion process the small pilot combustor, combined with very hot cooling air (above 750° C.) premixed with fuel act as a flameless burner, where reactants (oxygen & fuel) are premixed with products of combustion and a distributed flame is established at the forward stagnation point of the swirl induced recirculation zone.

To enable a proper function and stable operation of the burner disclosed in the present application, it is required that the imparted level of swirl and the swirl number (equation 1) is above the critical one (not lower then 0.6 and not higher then 0.8) at which vortex breakdown—recirculation zone will form and will be firmly positioned within the multi quarl arrangement. The forward stagnation point P should be located within the quarl and at the exit of the pilot combustor. The main reasons, for this requirement, are:

If the imparted level of swirl is low and the resulting swirl number is below 0.6, for most burner geometries, a weak, recirculation zone will form and unstable combustion can occur.

A strong recirculation zone is required to enable transport of heat and free radicals from the previously combusted fuel and air, back upstream towards the flame front. A well established and a strong recirculation zone is required to provide a shear layer region where turbulent flame speed can "match" or be proportional to the local fuel/air mixture, and a stable flame can establish. This flame front established in the shear layer of the main recirculation zone has to be steady and no periodic movements or procession of the flame front should occur. The imparted swirl number can be high, but should not be higher then 0.8, because at and above this swirl number more then 80% of the total amount of the flow will be recirculated back. A further increase in swirl number will not contribute more to the increase in the amount of the recirculated mass of the combustion products, and the flame in the shear layer of the recirculation zone will be subjected to high turbulence and strain which can result in quenching and partial extinction and reignition of the flame. Any type of the swirl generator, radial, axial and axial-radial can be used in the burner, covered by this disclosure. In this disclosure a radial swirler configuration is shown.

The burner utilizes aerodynamics stabilization of the flame and confines the flame stabilization zone—the recirculation zone—in the multiple quarl arrangement. The multiple quarl arrangement is an important feature of the design of the provided burner for the following reasons. The quarl (or also called diffuser):

provides a flame front (main recirculation zone) anchoring the flame in a defined position in space, without a need to anchor the flame to a solid surface/bluff body, and in that way a high thermal loading and issues related to the burner mechanical integrity are avoided;

geometry (quarl half angle $\alpha$ and length L) is important to control size and shape of the recirculation zone in conjunction with the swirl number. The length of the recirculation zone is roughly proportional to 2 to 2.5 of the quarl length;

optimal length L is of the order of L/D=1 (D is the quarl throat diameter). The minimum length of the quarl should not be smaller then L/D=0.5 and not longer then L/D=2;

optimal quarl half angle $\alpha$ should not be smaller then 20 and larger then 25 degrees, allows for a lower swirl before decrease in stability, when compared to a less confined flame front; and has the important task to control the size and shape of the recirculation zone as the expansion of the hot gases as a result of combustion reduces transport time of free radicals in the recirculation zone.

The efficiency of the premix of air and fuel in the one or more channels providing air and fuel to the main flame burning in the lean premixed air/fuel swirl is very important in order to obtain good results. Thus a new improved gas injector as disclosed in the present invention is used for this purpose. The gas injectors according to the invention are performed as tubes inserted into the air flow at the inlet of a swirler for premixing channels of the burner. Further details are described in the embodiments below.

EMBODIMENTS OF THE INVENTION

In the following a number of embodiments of the invention will be described in more detail with references to the enclosed drawings.

Figure 1:
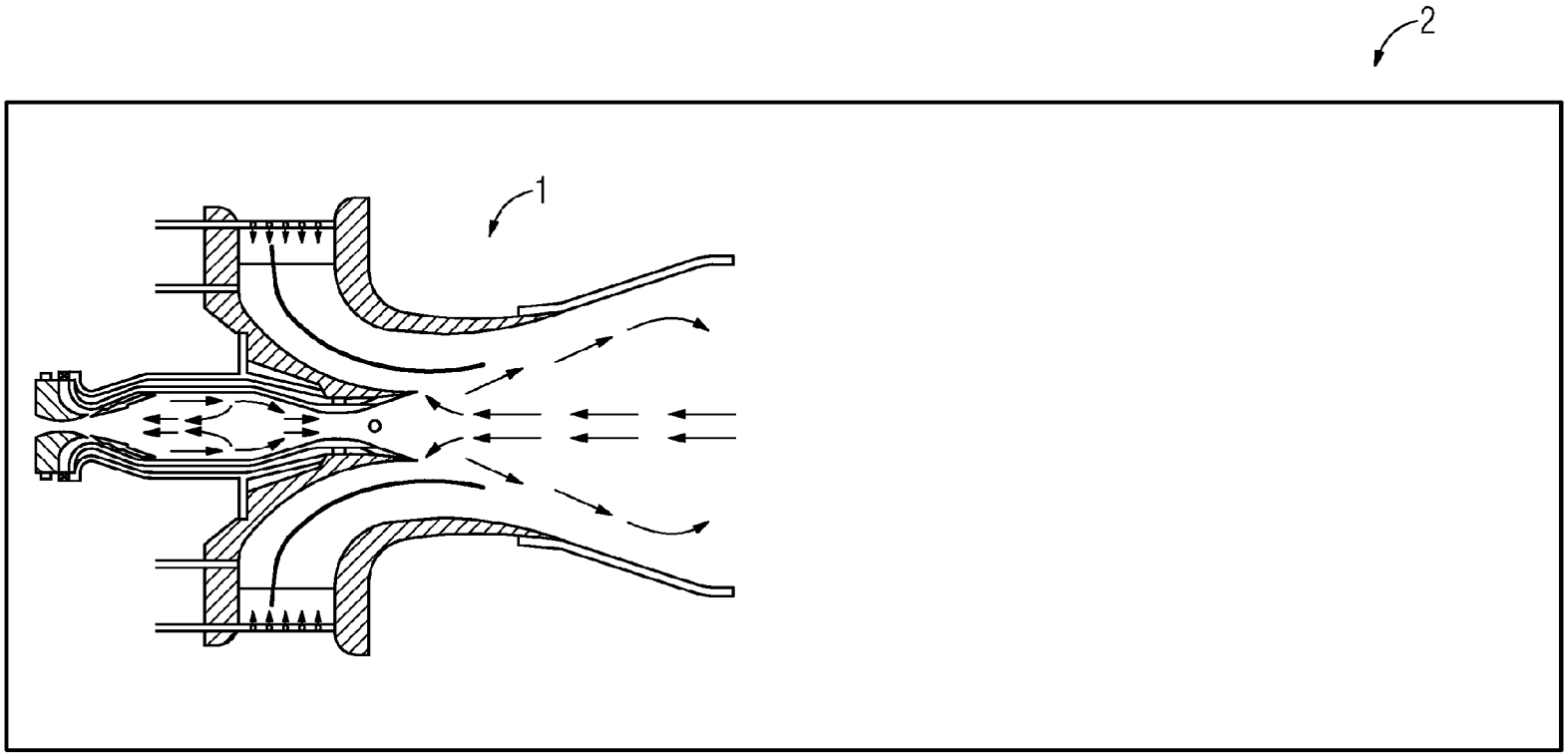
FIG. 1 is a simplified cross section schematically showing the burner according to the aspects of the invention enclosed in a housing without any details showing how the burner is configured inside said housing.

In FIG. 1 the burner is depicted with the burner 1 having a housing 2 enclosing the burner components.

Figure 2:
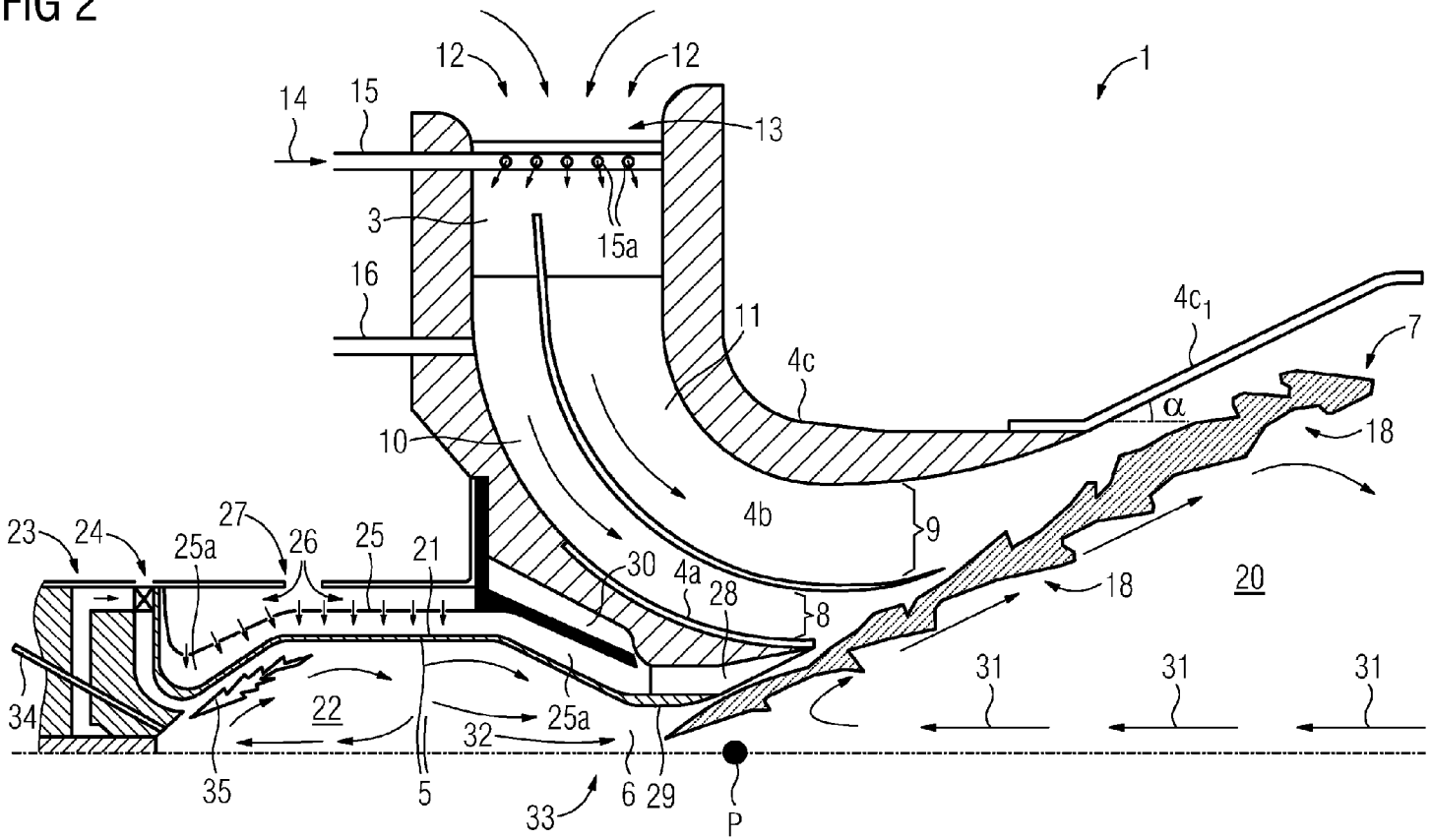
FIG. 2 is a cross section through the burner schematically showing a section above a symmetry axis, whereby a rotation around the symmetry axis forms a rotational body displaying a layout of the burner.

FIG. 2 shows for the sake of clarity a cross sectional view of the burner above a rotational symmetry axis. The main parts of the burner are the radial swirler 3, the multi quarl 4*a*, 4*b*, 4*c* and the pilot combustor 5.

As stated, the burner 1 operates according to the principle of "supplying" heat and high concentration of free radicals from the a pilot combustor 5 exhaust 6 to a main flame 7 burning in a lean premixed air/fuel swirl emerging from a first exit 8 of a first lean premixing channel 10 and from a second exit 9 of a second lean premixing channel 11, whereby a rapid and stable combustion of the main lean premixed flame 7 is supported. Said first lean premixing channel 10 is formed by and between the walls 4*a* and 4*b* of the multi quarl. The second lean premixing channel 11 is formed by and between the walls 4*b* and 4*c* of the multi quarl. The outermost rotational symmetric wall 4*c* of the multi quarl is provided with an extension 4*c*1 to provide for the optimal length of the multi quarl arrangement. The first 10 and second 11 lean premixing channels are provided with swirler wings forming the swirler 3 to impart rotation to the air/fuel mixture passing through the channels.

Air 12 is provided to the first 10 and second 11 channels at the inlet 13 of said first and second channels. According to the embodiment shown the swirler 3 is located close to the inlet 13 of the first and second channels. Further, fuel 14 is introduced to the air/fuel swirl through a tube 15 provided with small diffusor holes 15*b* located at the air 12 inlet 13 between the swirler 3 wings, whereby the fuel is distributed into the air flow through said holes as a spray and effectively mixed with the air flow. Additional fuel can be added through a second tube 16 emerging into the first channel 10.

When the lean premixed air/fuel flow is burnt the main flame 7 is generated. The flame 7 is formed as a conical rotational symmetric shear layer 18 around a main recirculation zone 20 (below sometimes abbreviated RZ). The flame 7 is enclosed inside the extension 4*c*1 of the outermost quarl, in this example quarl 4*c*.

The pilot combustor 5 supplies heat and supplements a high concentration of free radicals directly to a forward stagnation point P and the shear layer 18 of the main swirl induced recirculation zone 20, where the main lean premixed flow is mixed with hot gases products of combustion provided by the pilot combustor 5.

The pilot combustor 5 is provided with walls 21 enclosing a combustion room for a pilot combustion zone 22. Air is supplied to the combustion room through fuel channel 23 and air channel 24. Around the walls 21 of the pilot combustor 5 there is a distributor plate 25 provided with holes over the surface of the plate. Said distributor plate 25 is separated a certain distance from said walls 21 forming a cooling space layer 25*a*. Cooling air 26 is taken in through a cooling inlet 27 and meets the outside of said distributor plate 25, whereupon the cooling air 26 is distributed across the walls 21 of the pilot combustor to effectively cool said walls 21. The cooling air 26 is after said cooling let out through a second swirler 28 arranged around a pilot quad 29 of the pilot combustor 5. Further fuel can be added to the combustion in the main lean flame 7 by supplying fuel in a duct 30 arranged around and outside the cooling space layer 25*a*. Said further fuel is then let out and into the second swirler 28, where the now hot cooling air 26 and the fuel added through duct 30 is effectively premixed.

A relatively large amount of fuel can be added to the small pilot combustor 5 cooling air which corresponds to very rich equivalence ratios ($\Phi>3$). Swirled cooling air and fuel and hot products of combustion from the small pilot combustor, can very effectively sustain combustion of the main lean flame 7 below, at and above LBO limits. The combustion process is very stable and efficient because hot combustion products and very hot cooling air (above 750° C.), premixed with fuel, provide heat and active species (radicals) to the forward stagnation point P of the main flame recirculation zone 20. During this combustion process the small pilot combustor 5, combined with very hot cooling air (above 750° C.) premixed with fuel act as a flameless burner, where reactants (oxygen & fuel) are premixed with products of combustion and a distributed flame is established at the forward stagnation point P of the swirl induced recirculation zone 20.

Figure 3:
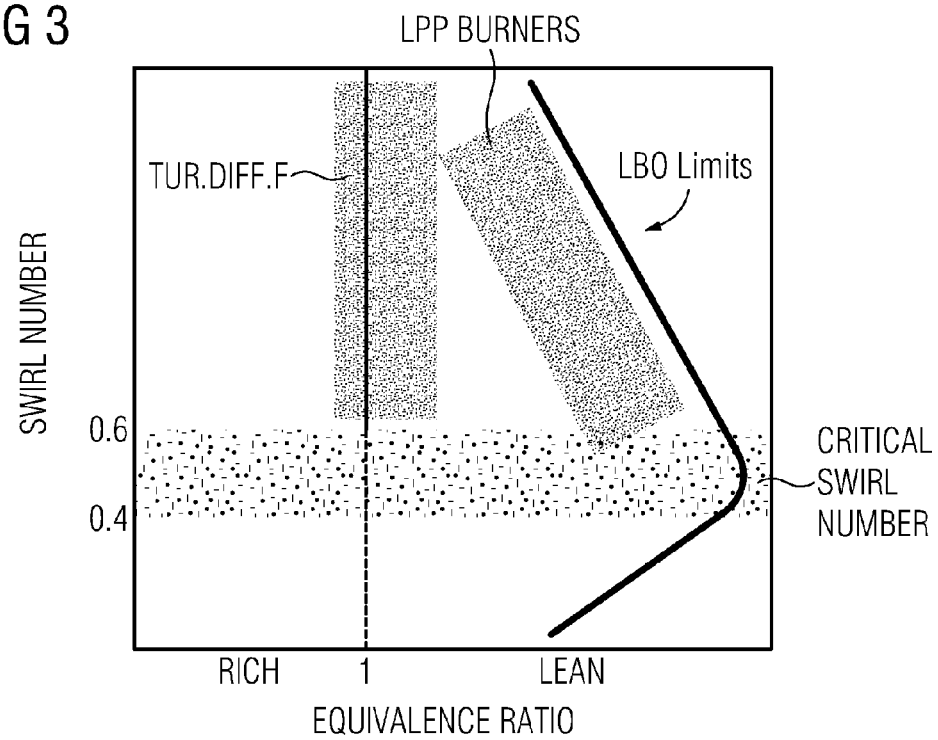
FIG. 3 shows a diagram of stability limits of the flame as a function of the swirl number, imparted level of swirl and equivalence ratio.

To enable a proper function and stable operation of the burner 1 disclosed in the present application, it is required that the imparted level of swirl and the swirl number is above the critical one (not lower then 0.6 and not higher then 0.8, see also FIG. 3) at which vortex breakdown—recirculation zone 20—will faun and will be thinly positioned within the multi quarl 4*a*, 4*b*, 4*c* arrangement. The forward stagnation point P should be located within the quarl 4*a*, 4*b*, 4*c* and at the exit 6 of the pilot combustor 5. Some main reasons, for this requirement, were mentioned in the summary above. A further reasons is:

If the swirl number is larger than 0.8, the swirling flow will extend to the exit of the combustor, which can result in an overheating of subsequent guide vanes of a turbine.

Figure 4A:
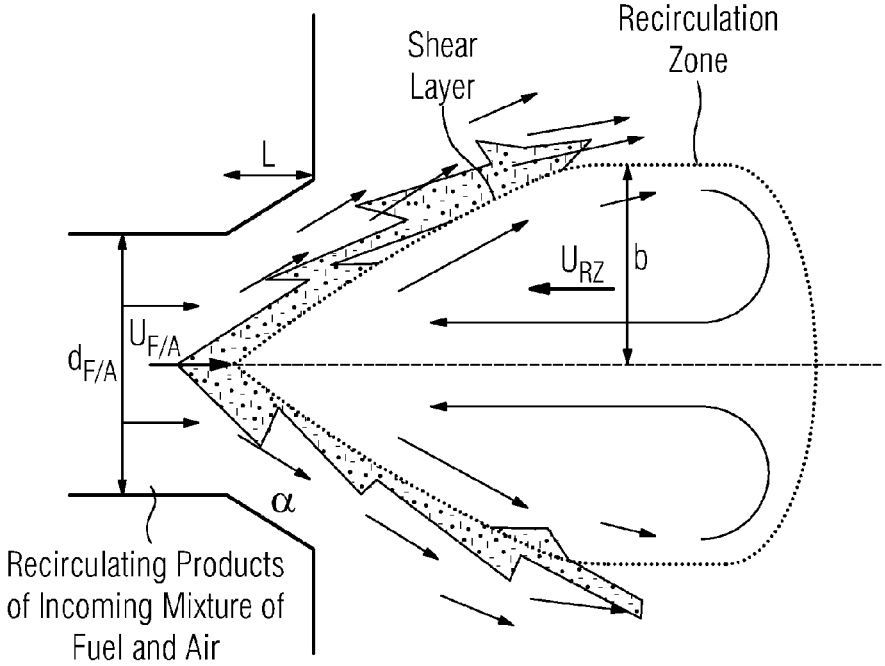
FIG. 4*a*: shows a diagram of combustor near field aerodynamics.

Below is presented a summary of the imparted level of swirl and swirl number requirements. See also FIGS. 4*a* and 4*b*.

The imparted level of swirl (the ratio between tangential and axial momentum) has to be higher then the critical one (0.4-0.6), so that a stable central recirculation zone 20 can form. The critical swirl number, SN, is also a function of the burner geometry, which is the reason for why it varies between 0.4 and 0.6. If the imparted swirl number is ≤0.4 or in the range of 0.4 to 0.6, the main recirculation zone 20, may not form at all or may form and extinguish periodically at low frequencies (below 150 Hz) and the resulting aerodynamics could be very unstable which will result in a transient combustion process.

In the shear layer 18 of the stable and steady recirculation zone 20, with strong velocity gradient and turbulence levels, flame stabilization can occur if:

turbulent flame speed (ST)>local velocity of the fuel air mixture (UF/A). Recirculating products which are: source of heat and active species (symbolized by means of arrows 1*a* and 1*b*), located within the recirculation zone 20, have to be stationary in space and time downstream from the mixing section of the burner 1 to enable pyrolysis of the incoming mixture of fuel and air. If a steady combustion process is not prevailing, thermo-acoustics instabilities will occur.

Swirl stabilized flames are up to five times shorter and have significantly leaner blow-off limits then jet flames.

A premixed or turbulent diffusion combustion swirl provides an effective way of premixing fuel and air.

The entrainiment of the fuel/air mixture into the shear layer of the recirculation zone 20 is proportional to the strength of the recirculation zone, the swirl number and the characteristics recirculation zone velocity URZ.

The characteristics recirculation zone velocity, URZ, can be expressed as:

$$URZ=UF/Af(MR,dF/A,\text{cent}/dF/A,SN),$$

wherein:

$$MR=r\text{cent}(UF/A,\text{cent})2/rF/A(UF/A)2$$

Experiments (Driscoll1990, Whitelaw1991) have shown that $$RZ\ \text{strength}=(MR)\exp-\tfrac{1}{2}(dF/A/dF/A,\text{cent})(URZ/UF/A)(b/dF/A),$$

and

MR should be <1.

(dF/A/dF/A,cent), only important for turbulent diffusion flames.

recirculation zones size/length is "fixed" and proportional to 2-2.5 dF/A.

Not more than approximately 80% of the mass recirculates back above SN=0.8 independently of how high SN is further increased Addition of Quarl-diverging walls downstream of the throat of the burner-enhances recirculation (Batchelor 67, Hallet 87, Lauckel 70, Whitelow 90); and Lauckel 70 has found that optimal geometrical parameters were: $\alpha$=20°-25°; L/dF/A, min=1 and higher.

This suggests that dquarl/dF/A=2-3, but stability of the flame suggests that leaner lean blow-off limits were achieved for values close to 2 (Whitelaw 90).

Experiments and practical experience suggest also that UF/A should be above 30-50 m/s for premixed flames due to risks of flashback (Proctor 85).

If a backfacing step is placed at the quarl exit, then external RZ if formed. the length of the external RZ, LERZ is usually ⅔ hERZ.

Active Species—Radicals

Figure 6:
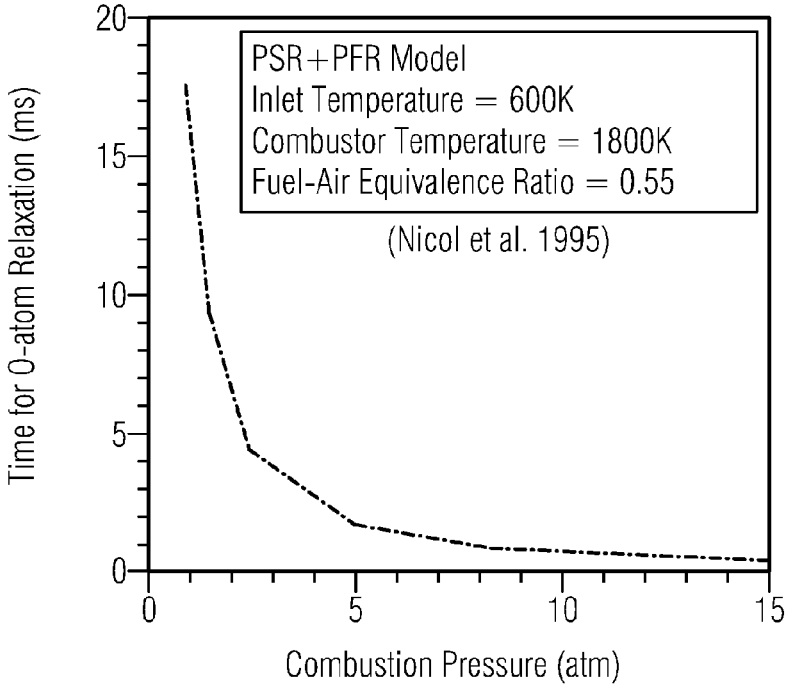
FIG. 6 shows a diagram of relaxation time as a function of combustion pressure.

In the swirl stabilized combustion, the process is initiated and stabilized by means of transporting heat and free radicals 31 from the previously combusted fuel and air, back upstream towards the flame front 7. If the combustion process is very lean, as is the case in lean-partially premixed combustion systems, and as a result the combustion temperature is low, the equilibrium levels of free radicals is also very low. Also, at high engine pressures the free radicals produced by the combustion process, quickly relax, see FIG. 6, to the equilibrium level that corresponds to the temperature of the combustion products. This is due to the fact that the rate of this relaxation of the free radicals to equilibrium increases exponentially with increase in pressure, while on the other hand the equilibrium level of free radicals decreases exponentially with temperature decrease. The higher the level of free radicals available for initiation of combustion the more rapid and stable the combustion process will tend to be. At higher pressures, at which burners in modern gas turbine engines operate in lean partially premixed mode, the relaxation time of the free radicals can be short compared to the "transport" time required for the free radicals (symbolized by arrows 31) to be convected downstream, from the point where they were produced in the shear layer 18 of the main recirculation zone 20, back upstream, towards the flame front 7 and the forward stagnation point P of the main recirculation zone 20. As a consequence, by the time that the reversely circulating flow of radicals 31 within the main recirculation zone 20 have conveyed free radicals 31 back towards the flame front 7, and when they begin to mix with the incoming "fresh" premixed lean fuel and air mixture from the first 10 and second 11 channels at the forward stagnation point P to initiate/sustain combustion process, the free radicals 31 could have reached low equilibrium levels.

This invention utilizes high non-equilibrium levels of free radicals 32 to stabilize the main lean combustion 7. In this invention, the scale of the small pilot combustor 5 is kept small and most of the combustion of fuel occurs in the lean premixed main combustor (at 7 and 18), and not in the small pilot combustor 5. The small pilot combustor 5, can be kept small, because the free radicals 32 are released near the forward stagnation point P of the main recirculation zone 20. This is generally the most efficient location to supply additional heat and free radicals to swirl stabilized combustion (7). As the exit 6 of the small pilot combustor 5 is located at the forward stagnation point P of the main-lean re-circulating flow 20, the time scale between quench and utilization of free radicals 32 is very short not allowing free radicals 32 to relax to low equilibrium levels. The forward stagnation point P of the main-lean re-circulating zone 20 is maintained and aerodynamically stabilized in the quarl (4*a*), at the exit 6 of the small pilot combustor 5. To assure that the distance and time from lean, stoichiometric or rich combustion (zone 22), within the small pilot combustor 5, is as short and direct as possible, the exit of the small pilot combustor 5 is positioned on the centerline and at the small pilot combustor 5 throat 33. On the centerline, at the small pilot combustor 5 throat 33, and within the quarl 4*a*, free radicals 32 are mixed with the products of the lean combustion 31, highly preheated mixture of fuel and air, from duct 30 and space 25*a*, and subsequently with premixed fuel 14 and air 12 in the shear layer 18 of the lean main recirculation zone 20. This is very advantageous for high-pressure gas turbine engines, which inherently exhibit the most severe thermo acoustic instabilities. Also, because the free radicals and heat produced by the small pilot combustor 5 are used efficiently, its size can be small and the quenching process is not required. The possibility to keep the size of the pilot combustor 5, small has also beneficial effect on emissions.

Fuel Staging and Burner Operation

Figure 4B:
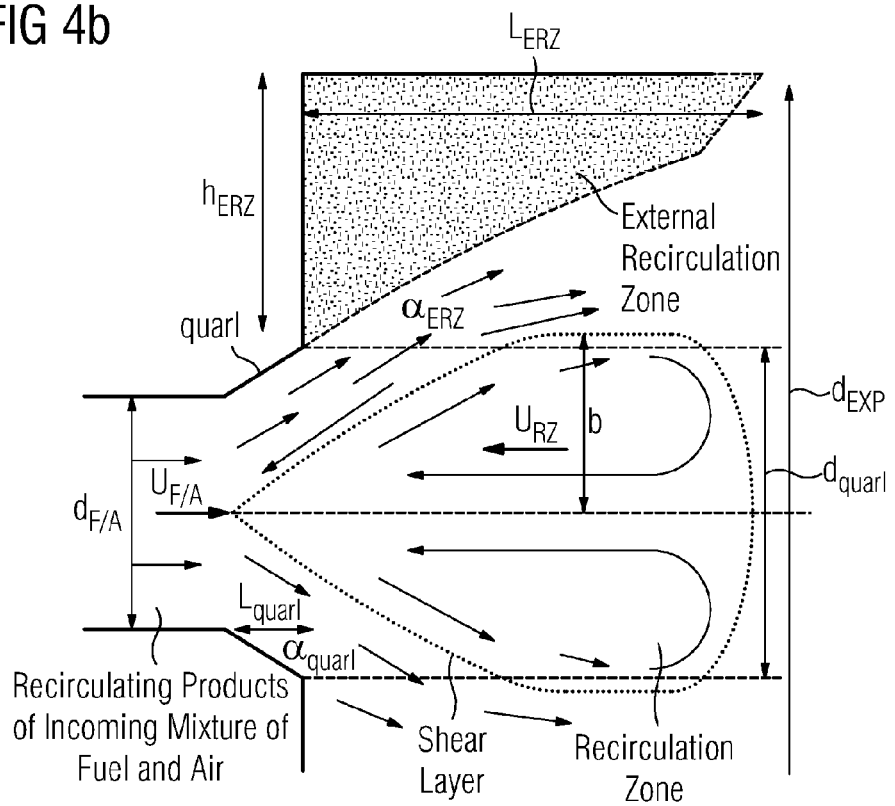
FIG. 4*b*: shows a diagram of combustor near field aerodynamics.
Figure 5:
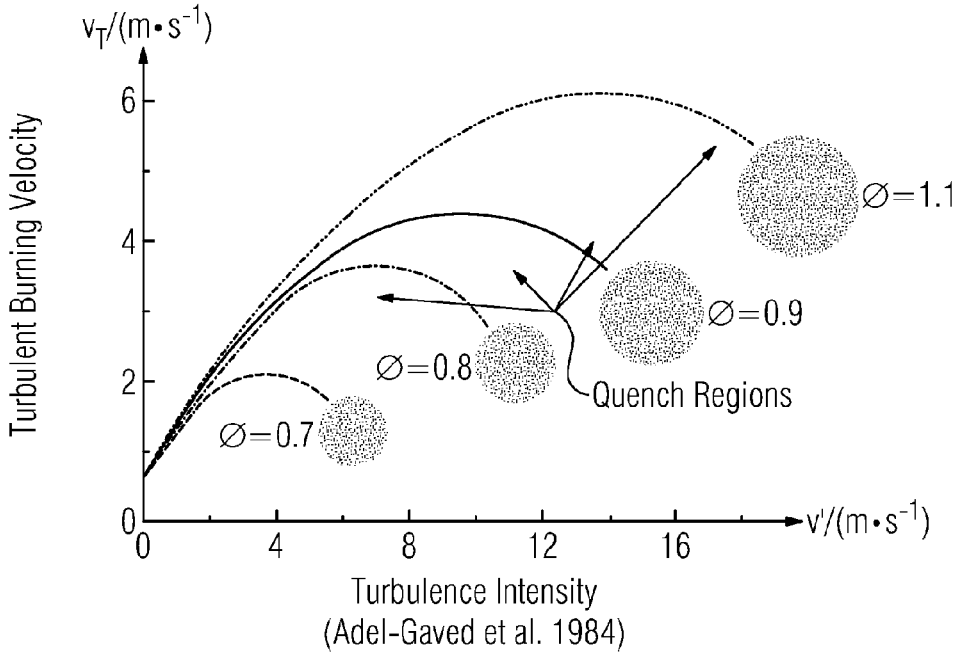
FIG. 5 shows a diagram of turbulence intensity.

When the igniter 34, as in prior art burners, is placed in the outer recirculation zone, which is illustrated in FIG. 4*b*, the fuel/air mixture entering this region must often be made rich in order to make the flame temperature sufficiently hot to sustain stable combustion in this region. The flame then often cannot be propagated to the main recirculation until the main premixed fuel and airflow becomes sufficiently rich, hot and has a sufficient pool of free radicals, which occurs at higher fuel flow rates. When the flame cannot propagate from the outer recirculation zone to the inner main recirculation zone shortly after ignition, it must propagate at higher pressure after the engine speed begins to increase. This transfer of the initiation of the main flame from the outer recirculation zone pilot only after combustor pressure begins to rise results in more rapid relaxation of the free radicals to low equilibrium levels, which is an undesirable characteristic that is counter productive for ignition of the flame at the forward stagnation point of the main recirculation zone. Ignition of the main recirculation may not occur until the pilot sufficiently raises the bulk temperature to a level where the equilibrium levels of free radicals entrained in the main recirculation zone and the production of addition free radicals in the premixed main fuel and air mixture are sufficient to ignite the main recirculation zone. In the process of getting the flame to propagate from the outer to the main recirculation zone, significant amounts of fuel exits the engine without burning from the un-ignited main premixed fuel and air mixture. A problem occurs if the flame transitions to the main recirculation zone in some burner before others in the same engine, because the burners where the flames are stabilized on the inside burn hotter since all of the fuel is burnt. This leads to a burner-to-burner temperature variation which can damage engine components.

The present invention also allows for the ignition of the main combustion 7 to occur at the forward stagnation point P of the main recirculation zone 20. Most gas turbine engines must use an outer recirculation zone, see FIG. 4*b*, as the location where the spark, or torch igniter, ignites the engine. Ignition can only occur if stable combustion can also occur; otherwise the flame will just blow out immediately after ignition. The inner or main recirculation zone 22, as in the present invention, is generally more successful at stabilizing the flame, because the recirculated gas 31 is transported back and the heat from the combustion products of the recirculated gas 31 is focused to a small region at the forward stagnation point P of the main recirculation zone 20. The combustion—flame front 7, also expands outwards in a conical shape from this forward stagnation point P, as illustrated in FIG. 2. This conical expansion downstream allows the heat and free radicals 32 generated upstream to support the combustion downstream allowing the flame front 7 to widen as it moves downstream. The quarl (4*a*, 4*b*, 4*c*), illustrated in FIG. 2, compared to swirl stabilized combustion without the quarl, shows how the quarl shapes the flame to be more conical and less hemispheric in nature. A more conical flame front allows for a point source of heat to initiate combustion of the whole flow field effectively.

In the present invention the combustion process within the burner 1 is staged. In the first stage, the ignition stage, lean flame 35 is initiated in the small pilot combustor 5 by adding fuel 23 mixed with air 24 and igniting the mixture utilizing ignitor 34. After ignition equivalence ratio of the flame 35 in the small pilot combustor 5 is adjusted at either lean (below equivalence ratio 1, and at approximately equivalence ratio of 0.8) or rich conditions (above equivalence ratio 1, and at approximately equivalence ratio between 1.4 and 1.6). The reason why the equivalence ratio within the small pilot combustor 5 is at rich conditions in the range between 1.4 and 1.6 is emission levels. It is possible to operate and maintain the flame 35 in the small combustor pilot 5 at stoichiometric conditions (equivalence ratio of 1), but this option is not recommended because it can result in high emission levels, and higher thermal loading of the walls 21. The benefit of operating and maintaining the flame 35 in the small pilot combustor at either lean or rich conditions is that generated emissions and thermal loading of the walls 21 are low.

In the next stage, a second-low load stage, fuel is added through duct 30 to the cooling air 27 and imparted a swirling motion in swirler 28. In this way combustion of the main lean flame 7, below, at and above LBO limits, is very effectively sustained. The amount of the fuel which can be added to the hot cooling air (preheated at temperatures well above 750 C), can correspond to equivalence ratios >3.

In the next stage of the burner operation, a third part and full load stage fuel 14 is gradually added to the air 12, which is the main air flow to the main flame 7.

The fuel 14, added as gas, is provided by means of gas injectors, in the form of tubes 15 inserted at the inlet end of swirler 3 having swirler wings 3*a* provided in the air/fuel premix channels 10, 11 opening into the combustion room of the burner. The gas injector tubes 15 disclose at their outer surfaces circular or helical V-formed grooves 40, which could be performed, as an example, as threads on the outside of the gas injector tubes, in this case forming helical grooves. Distributed along the axial direction of the tubes 15 are holes 15*a* as outlets for the gaseous fuel 14. Said holes 15*a* are arranged to be located at the bottom of the grooves 40. The reason for this is that the gaseous fuel 14 flowing out through the holes 15*a* will form small vortices in the grooves, thus enhancing the turbulence of the flow of fuel close to the gas injector tubes 15 and improving the mixing with air 12 which is passing around the tubes 15.

Figure 7A:
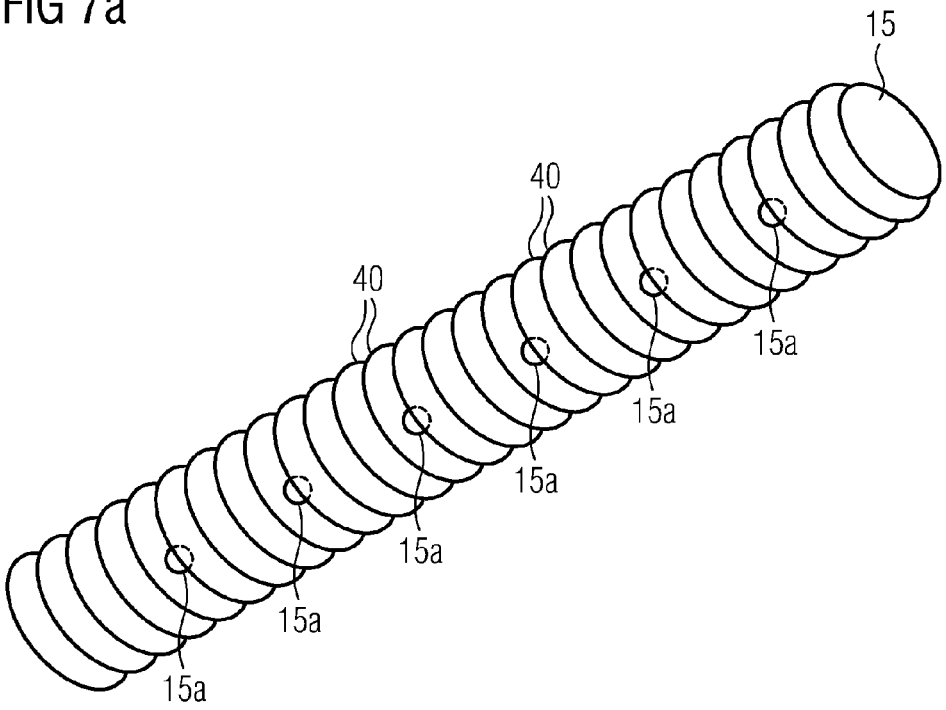
FIG. 7*a* illustrates in a perspective view an example of a fuel tube 15 and FIG. 7*b* shows fuel tubes distributed at the inlet of a swirler 3.
Figure 7B:
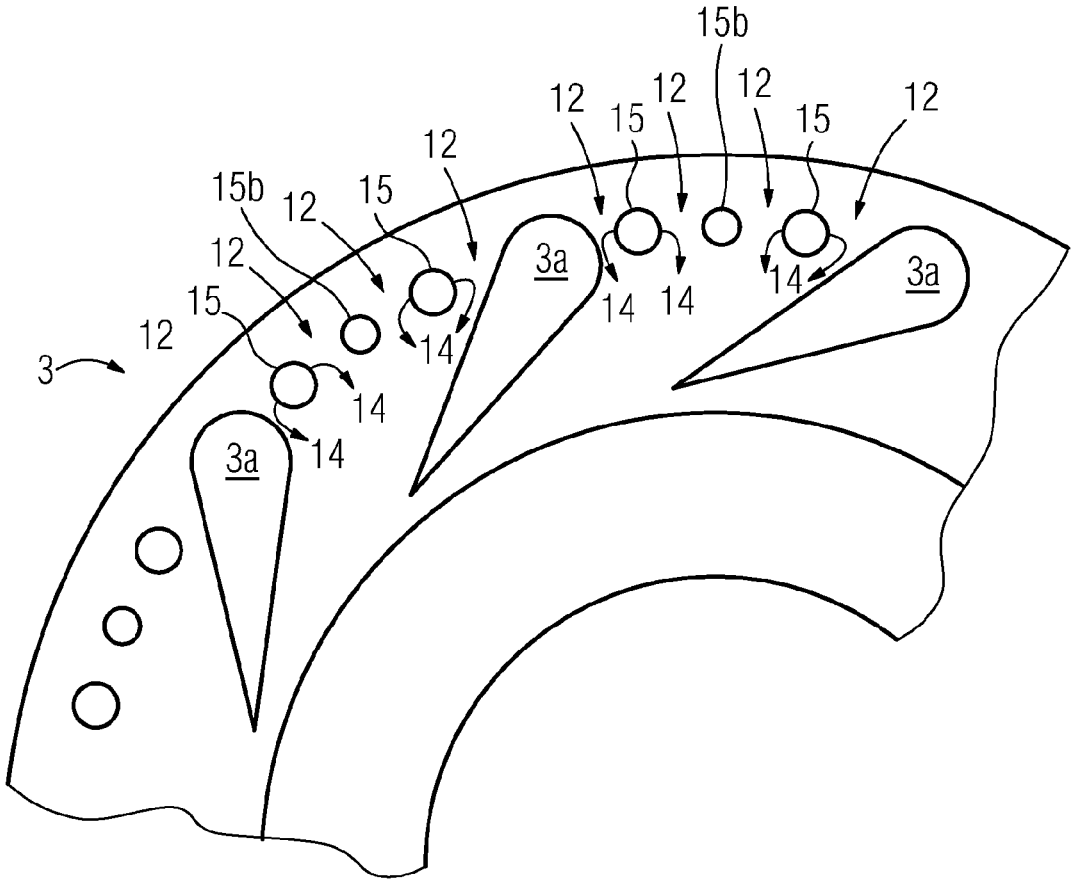

In a preferred example two rows of approximately diametrically opposed holes 15*a* are arranged (or the rows of holes being arranged along the tubes such that the fuel is injected perpendicular to the air flow in the swirler 3), whereby the gas is outlet into the air 12 flow on two sides of the tubes substantially perpendicular to the air flow. This is illustrated in FIG. 7*b*. In FIG. 7*b* is also shown the mixing rod 15*b* between two fuel tubes 15 schematically shown in a cross sectional view of a portion of a swirler 3.

The invention claimed is:

1. A burner of a gas turbine engine comprising:

a swirler; and a gas injector for injecting fuel into a flow of air in the swirler, wherein the gas injector is arranged at an inlet of a channel of the swirler, the gas injector comprises:

a gas injector tube for a provision of the fuel, wherein the gas injector tube includes a plurality of diffuser holes distributed along the tube acting as gas injectors for effectively distributing fuel in the flow of air passing the gas injector tube, the fuel being injected in a direction perpendicular to the flow of air, wherein the gas injector tube includes along an outer surface, a plurality of circular or helical V-formed grooves, and wherein the plurality of diffuser holes are arranged at a bottom of the plurality of grooves.

2. The burner as claimed in claim 1, wherein the plurality of grooves are arranged as helical threads.

3. The burner as claimed in claim 1, wherein two rows of diametrically opposed diffuser holes are arranged whereby a gas is outlet into the flow of air on two diametrically opposed sides of the tubes approximately perpendicular to the flow of air.

4. The burner as claimed in claim 3, wherein the diffuser holes of a first row of the plurality of diffuser holes of the gas injector tube is arranged in a zigzag manner with respect to the diffuser holes of a second row of the plurality of diffuser holes of the gas injector tube.

5. The burner as claimed in claim 1, wherein the two rows of diffuser holes are arranged along the gas injector tube whereby fuel injected into the flow of air is injected in a direction approximately perpendicular to the direction of the flow of air.

6. The burner as claimed in claim 5, wherein the of diffuser holes of a first row of the plurality of diffuser holes of the gas injector tube is arranged in a zigzag manner with respect to the diffuser holes of a second row of the plurality of diffuser holes of the gas injector tube.

* * * * *